US007119691B2

(12) United States Patent
Leone

(10) Patent No.: US 7,119,691 B2
(45) Date of Patent: Oct. 10, 2006

(54) ELECTRONIC ARTICLE SURVEILLANCE MARKER DEACTIVATOR USING PHASE CONTROL DEACTIVATION

(75) Inventor: Steven V. Leone, Lake Worth, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 0 days.

(21) Appl. No.: 10/688,822

(22) Filed: Oct. 17, 2003

(65) Prior Publication Data

US 2005/0083202 A1 Apr. 21, 2005

(51) Int. Cl.
*G08B 13/14* (2006.01)

(52) U.S. Cl. ..... 340/572.3; 361/149

(58) Field of Classification Search ..... 340/572.3, 340/572.1; 361/149
See application file for complete search history.

(56) References Cited

U.S. PATENT DOCUMENTS

| | | | | |
|---|---|---|---|---|
| 4,617,603 | A | 10/1986 | Johnson et al. | 361/149 |
| 4,901,579 | A * | 2/1990 | Butts | 361/149 |
| 5,493,275 | A | 2/1996 | Easter | 340/572 |
| 5,781,111 | A | 7/1998 | Easter et al. | |
| 5,825,604 | A * | 10/1998 | Ikeda et al. | 361/149 |
| 5,867,101 | A * | 2/1999 | Copeland et al. | 340/572.3 |
| 5,907,465 | A | 5/1999 | Easter | 361/149 |
| 6,111,507 | A * | 8/2000 | Alicot et al. | 340/572.3 |

* cited by examiner

*Primary Examiner*—Thomas Mullen

(57) ABSTRACT

A method and apparatus to deactivate an EAS security tag are described.

22 Claims, 6 Drawing Sheets

ELECTRONIC ARTICLE SURVEILLANCE MARKER DEACTIVATOR USING PHASE CONTROL DEACTIVATION

BACKGROUND

An Electronic Article Surveillance (EAS) system is designed to prevent unauthorized removal of an item from a controlled area. A typical EAS system may comprise a monitoring system and one or more security tags. The monitoring system may create an interrogation zone at an access point for the controlled area. A security tag may be fastened to an item, such as an article of clothing. If the tagged item enters the interrogation zone, an alarm may be triggered indicating unauthorized removal of the tagged item from the controlled area.

When a customer presents an article for payment at a checkout counter, a checkout clerk either removes the security tag from the article, or deactivates the security tag using a deactivation device. In the latter case, improvements in the deactivation device may facilitate the deactivation operation, thereby increasing convenience to both the customer and clerk. Consequently, there may be need for improvements in deactivating techniques in an EAS system.

BRIEF DESCRIPTION OF THE DRAWINGS

The subject matter regarded as the embodiments is particularly pointed out and distinctly claimed in the concluding portion of the specification. The embodiments, however, both as to organization and method of operation, together with objects, features, and advantages thereof, may best be understood by reference to the following detailed description when read with the accompanying drawings in which:

DETAILED DESCRIPTION

Numerous specific details may be set forth herein to provide a thorough understanding of the embodiments of the invention. It will be understood by those skilled in the art, however, that the embodiments of the invention may be practiced without these specific details. In other instances, well-known methods, procedures, components and circuits have not been described in detail so as not to obscure the embodiments of the invention. It can be appreciated that the specific structural and functional details disclosed herein may be representative and do not necessarily limit the scope of the invention.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

One embodiment of the invention may be directed to a deactivator for an EAS system. The deactivator may be used to deactivate an EAS security tag using phase control of an alternating current (AC) voltage. The security tag may comprise, for example, an EAS marker encased within a hard or soft outer shell. The deactivator may create a magnetic field using phase control of the AC current voltage to deactivate the marker. Once deactivated, the EAS security tag may pass through the interrogation zone without triggering an alarm. The deactivator may be described in more detail with reference to FIG. 1.

Figure 1:
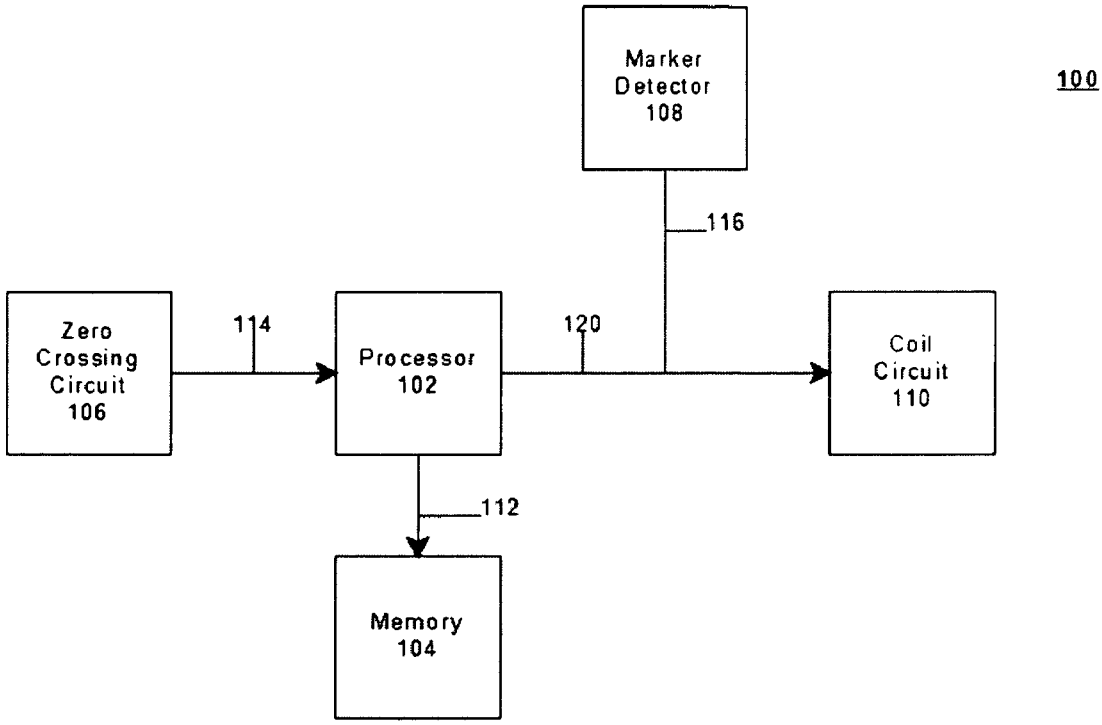
FIG. 1 illustrates a block diagram of a deactivator in accordance with one embodiment.

Referring now in detail to the drawings wherein like parts are designated by like reference numerals throughout, there is illustrated in FIG. 1 a block diagram of a deactivator 100. Deactivator 100 may comprise a plurality of nodes. The term "node" as used herein may refer to an element, module, component, board or device that may process a signal representing information. The term "module" as used herein may refer to one or more circuits, registers, processors, software subroutines, or any combination thereof could be substituted for one, several, or all of the modules. The signal may be, for example, an electrical signal, optical signal, acoustical signal, chemical signal, and so forth.

In one embodiment, deactivator 100 may comprise a zero-crossing circuit 106 connected to a processor 102 via line 114. Processor 102 may be connected to a coil circuit 110 via line 120, and memory 104 via line 112. Marker detector 108 may be connected to coil circuit 110 via line 120. Although a limited number of nodes are shown in FIG. 1, it may be appreciated that the functionality for the various nodes may be implemented using more or less nodes and still fall within the scope of the embodiments.

In one embodiment, deactivator 100 may comprise marker detector 108. Marker detector 108 may comprise transmit/receive coils and associated processing circuitry to detect the presence of an EAS marker for an EAS security tag. Alternatively, marker detector 108 may also be part of coil circuit 110. Once detector 108 detects the presence of an EAS marker, it may send a signal to zero crossing circuit 106 via line 116 to initiate the deactivation operation to deactivate the EAS marker, thereby rendering it undetectable by the EAS detection equipment when passing through the interrogation zone.

In one embodiment, deactivator 100 may comprise a zero crossing circuit 106. Zero-crossing detector 106 may monitor an alternating current (AC) input voltage waveform provided to coil circuit 110. Zero-crossing detector 106 may produce a pulse at each transition of the AC input voltage waveform ("zero-crossing"). The transition may be either from positive to negative or from negative to positive. Zero-crossing detector 106 may output a signal comprising a train of pulses via line 114 to processor 102, with each pulse representing a zero-crossing of the AC input voltage waveform.

In one embodiment, deactivator 100 may comprise a processor 102 and memory 104. The type of processor may vary in accordance with any number of factors, such as desired computational rate, power levels, heat tolerances, processing cycle budget, input data rates, output data rates, memory resources, data bus speeds and other performance constraints. For example, the processor may be a general-purpose or dedicated processor, such as a processor made by Intel® Corporation, for example. Processor 102 may execute software. The software may comprise computer program code segments, programming logic, instructions or data. The software may be stored on a medium accessible by a machine, computer or other processing system, such as memory 104. Memory 104 may comprise any computer-readable mediums, such as read-only memory (ROM), random-access memory (RAM), Programmable ROM (PROM), Erasable PROM (EPROM), magnetic disk, optical disk, and so forth. In one embodiment, the medium may store programming instructions in a compressed and/or encrypted format, as well as instructions that may have to be compiled or installed by an installer before being executed by the processor. In another example, the functions performed by processor 102 may also be implemented as dedicated hardware, such as an Application Specific Integrated Circuit (ASIC), Programmable Logic Device (PLD) or Digital Signal Processor (DSP) and accompanying hardware structures. In yet another example, the functions performed by processor 102 may be implemented by any combination of programmed general-purpose computer components and custom hardware components. The embodiments are not limited in this context.

In one embodiment, processor 102 may generate a timing signal to provide timing information to coil circuit 110. In one embodiment, processor 102 may receive the zero-crossing signal from zero-crossing detector 106. Processor 102 may use the zero-crossing signal to determine a reference time. The reference time may comprise the leading edge or falling edge of a pulse in the zero-crossing signal. Processor 102 may use the reference time to interpolate a zero-crossing period for the AC input voltage waveform. For example, the zero-crossing period for an AC input voltage waveform typically used in the United States may correspond to approximately 60 Hertz (Hz). In another example, the zero-crossing period for an AC input voltage waveform typically used in Europe may correspond to approximately 50 Hz. Once processor 102 determines the zero-crossing period, processor 102 may retrieve a plurality of delay times corresponding to the zero-crossing period. The delay times may be predetermined and stored as part of a timing table in memory 104 and retrieved via line 112. The delay times may also be calculated during run time using the appropriate equations. Processor 102 may use the retrieved delay times and zero-crossings to generate a timing signal for coil circuit 110. The delay times and timing signal are described in more detail with reference to FIGS. 2–6. Processor 102 may send the timing signal to coil circuit 110 via line 120.

In one embodiment, deactivator 100 may comprise coil circuit 110. Coil circuit 110 may receive the timing signals from processor 102. Coil circuit 110 may use the timing signals to energize one or more coils at predetermined time intervals. The energized coils may generate a magnetic field having an amplitude profile sufficient to deactivate or render inactive an EAS marker for an EAS security tag. The term "amplitude profile" may refer to the peak amplitudes of a waveform over a given time interval.

In one embodiment, coil circuit 110 may generate a magnetic field having an amplitude profile sufficient to deactivate a "magneto-mechanical" EAS marker. Magneto-mechanical EAS markers may include an active element and a bias element. When the bias element is magnetized in a certain manner, the resulting bias magnetic field applied to the active element causes the active element to be mechanically resonant at a predetermined frequency upon exposure to an interrogation signal which alternates at the predetermined frequency. The EAS detection equipment used with this type of EAS marker generates the interrogation signal and then detects the resonance of the EAS marker induced by the interrogation signal. To deactivate the magneto-mechanical EAS markers, the bias element may be degaussed by exposing the bias element to an alternating magnetic field that has an initial magnitude that is greater than the coercivity of the bias element, and then decays to zero over a time interval. After the bias element is degaussed, the EAS marker's resonant frequency is substantially shifted from the predetermined interrogation signal frequency, and the EAS marker's response to the interrogation signal is at too low an amplitude for detection by the detecting apparatus.

In one embodiment, coil circuit 110 may generate the desired magnetic field without the use of high voltage capacitors. High voltage capacitors are typically a significant percentage of the deactivator size and cost. Further, high voltage capacitors need time to charge after each use. Typically the charge time may be 0.5 to 1.5 seconds, for example. The charge time may limit the throughput of products having an EAS marker over the device. Throughput may be particularly important in those applications having a low tolerance to latency, such as the food service industry, for example. By obviating the need for high voltage capacitors, deactivator 100 may be smaller and less expensive then conventional deactivators, and may also increase throughput of security tags through deactivator 100.

Figure 2:
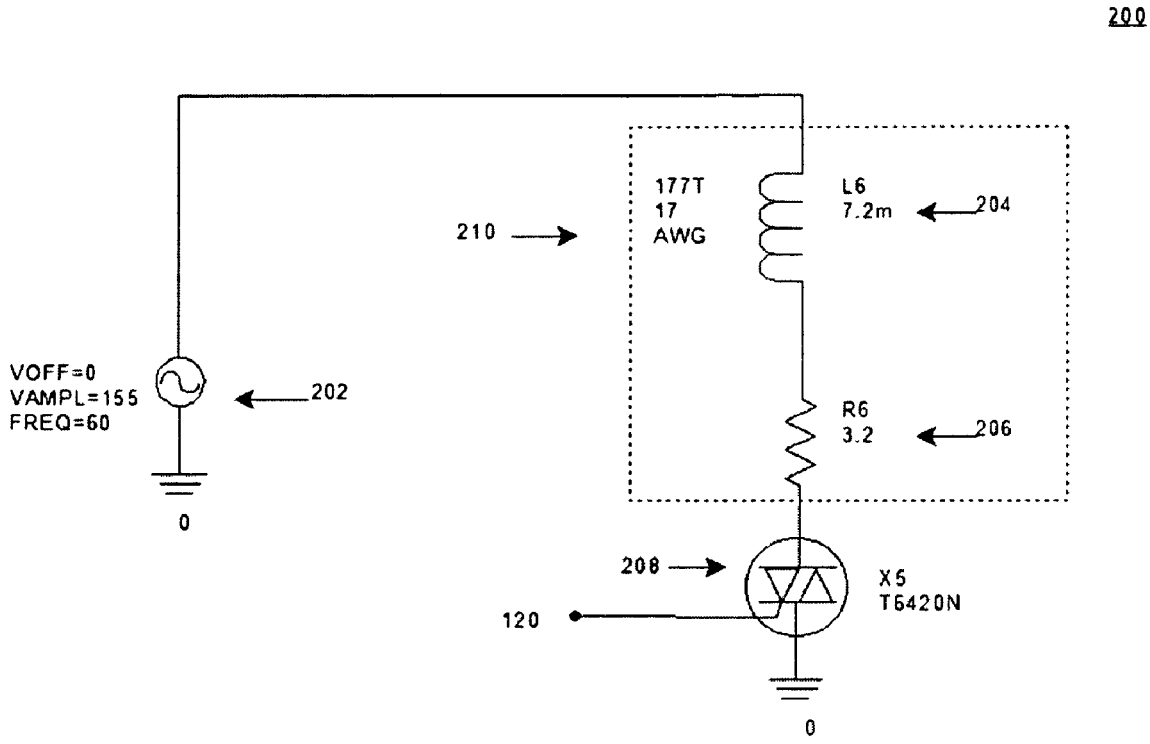
FIG. 2 illustrates a block diagram of a coil circuit in accordance with one embodiment.

FIG. 2 illustrates a block diagram of a coil circuit in accordance with one embodiment. FIG. 2 illustrates a coil circuit 200. Coil circuit 200 may be representative of, for example, coil circuit 110. In one embodiment, coil circuit 200 may comprise a series LR circuit that is tied on one side to an AC line voltage source 202, and on the other side to a high voltage low side electronic power switch 208. The AC line voltage source 202 may provide a 110 or 220 volt 60 Hz power supply as provided by a power company, for example. An example of switch 208 may comprise a Triode Alternating Current (TRIAC) switch. An inductive EAS antenna such as coil 210 may be positioned between AC voltage source 202 and switch 208. Coil 210 may comprise, for example, an inductor 204 and a resistor 206, with resistor 206 being parasitic.

In one embodiment, switch 208 may be fired in accordance with the timing signal from processor 102, for example. The firing times may allow current to flow through coil 210. The amount of coil current may be inversely proportional to the fire delay time. By firing switch 208 each half cycle at progressively increasing delay times relative to the AC zero-crossings, an exponentially decaying AC current may flow through the windings of coil 210. This may produce a decaying magnetic field proportional to the number of turns in coil 210 times the peak coil current. The resulting decaying magnetic field may be sufficient to deactivate an EAS marker for an EAS security tag.

In one embodiment, processor 102 may generate the timing signal using an array of delay times and zero-crossing information generated by zero-crossing detector 106. Each delay time may represent a time interval between a zero-crossing and start time to fire switch 208. The delay times may get longer for each successive firing. Since the current flowing through coil 210 is inversely proportional to the delay time, the peak amplitude for each cycle in the coil current waveform may decrease over time, thereby creating the decaying magnetic field. Consequently, a coil current waveform and resulting magnetic field of a desired amplitude profile may be generated in accordance with the appropriate delay times. The relationship between delay times and coil current may be further described with reference to FIGS. 3A and 3B.

Figure 3A:
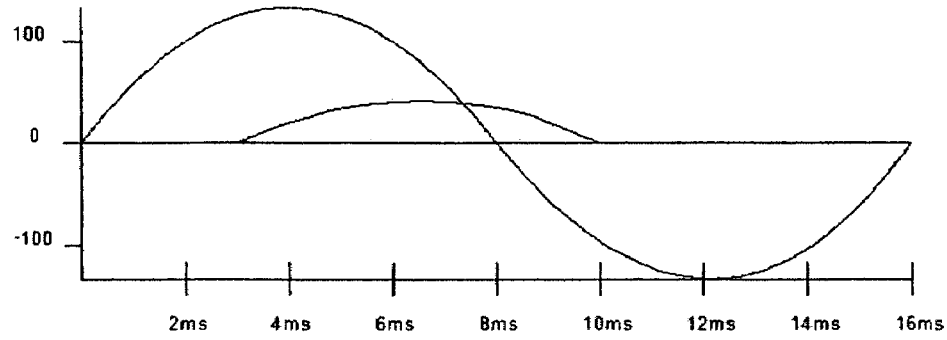
FIGS. 3A and 3B illustrate graphs showing current peak amplitudes for a pair of delay times in accordance with one embodiment.
Figure 3B:
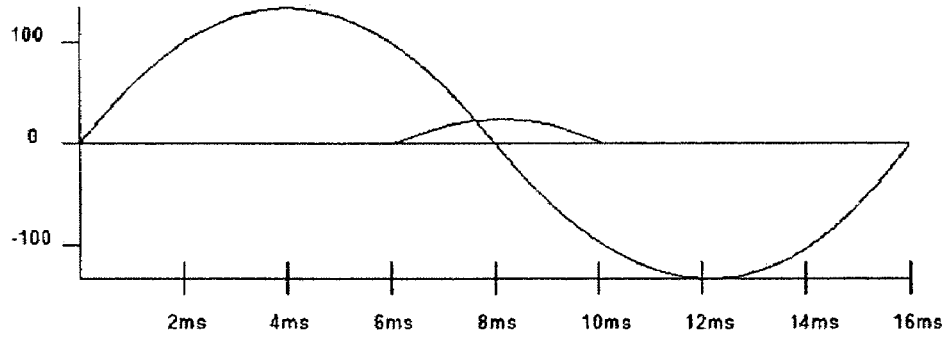

FIGS. 3A and 3B illustrate graphs showing current peak amplitudes for a pair of delay times in accordance with one embodiment. As shown in FIGS. 3A and 3B, switch 208 may be closed at a precise delay time (angle) relative to the zero crossing for the AC input voltage waveform to start coil current for coil 210. Switch 208 may naturally commutate back to an open state over a period of time, thereby preventing the AC input voltage from being applied to coil 210. The result is a coil current having a peak amplitude over a given time period. As shown in FIGS. 3A and 3B, an early firing time produces a higher peak amplitude than a later firing time. For example, FIG. 3A illustrates a graph of the coil current for coil 210 when switch 208 is closed after a 3 millisecond (ms) delay from the initial zero-crossing of an AC input voltage waveform. Coil current may be allowed to flow through coil 210, with the coil current having a peak amplitude of approximately 38 Amperes (Amps). By way of contrast, FIG. 3B illustrates a graph of the coil current for coil 210 when switch 208 is closed after a 6 ms delay from the initial zero-crossing of the AC input voltage waveform. The peak amplitude for the resulting coil current in this case may be lower than shown in FIG. 3A, or approximately 16 Amps.

Figure 4:
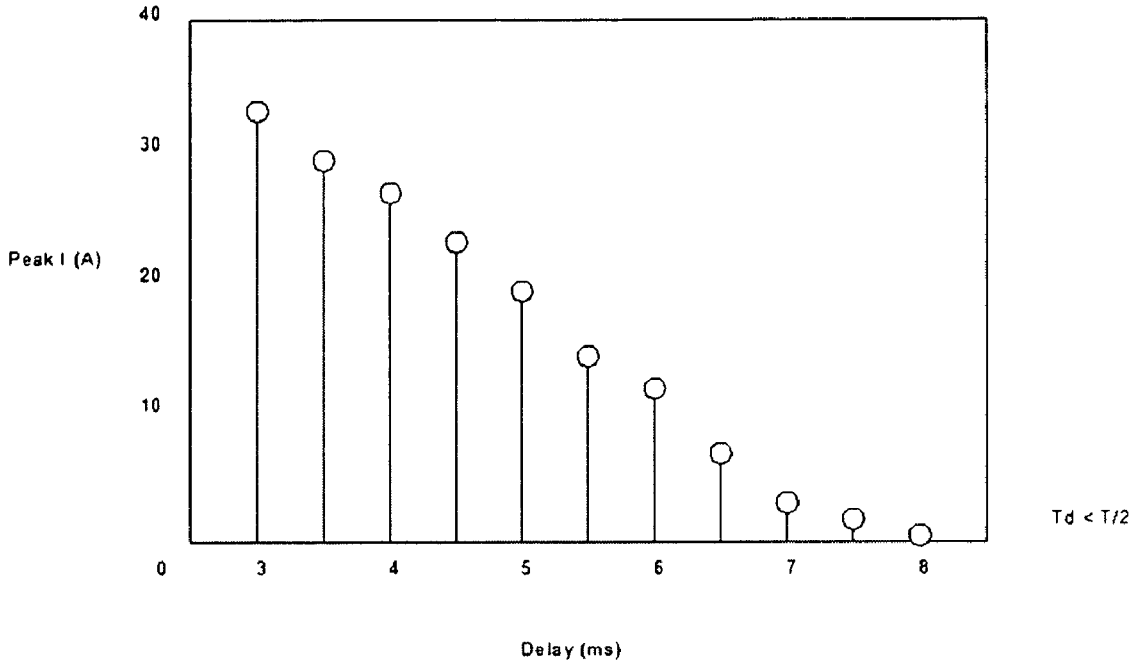
FIG. 4 illustrates a graph showing various peak amplitudes for different delay times in accordance with one embodiment.

FIG. 4 illustrates a graph showing various peak amplitudes for different delay times in accordance with one embodiment. As shown by FIGS. 3A and 3B, coil current for coil 210 may be decayed in a precise manner by varying the delay times relative to the zero-crossings for the AC input voltage waveform. FIG. 4 illustrates a plurality of delay times and their corresponding peak amplitudes for the coil current for coil 210. As shown in FIG. 4, peak amplitudes for the coil current decrease as the time interval for the delay time increases. For example, the peak amplitude for the coil current may start at approximately 30 Amps with a 3 ms delay time, and may progressively decrease to 0 as the delay time is increased to an 8 ms delay time. It is worthy to note that the time interval for each delay time is constrained to be less than half the AC input voltage waveform cycle period, as represent by $T_d<T/2$. This is because the AC input voltage switches polarity, and therefore, the current produced would also switch polarity.

Figure 5:
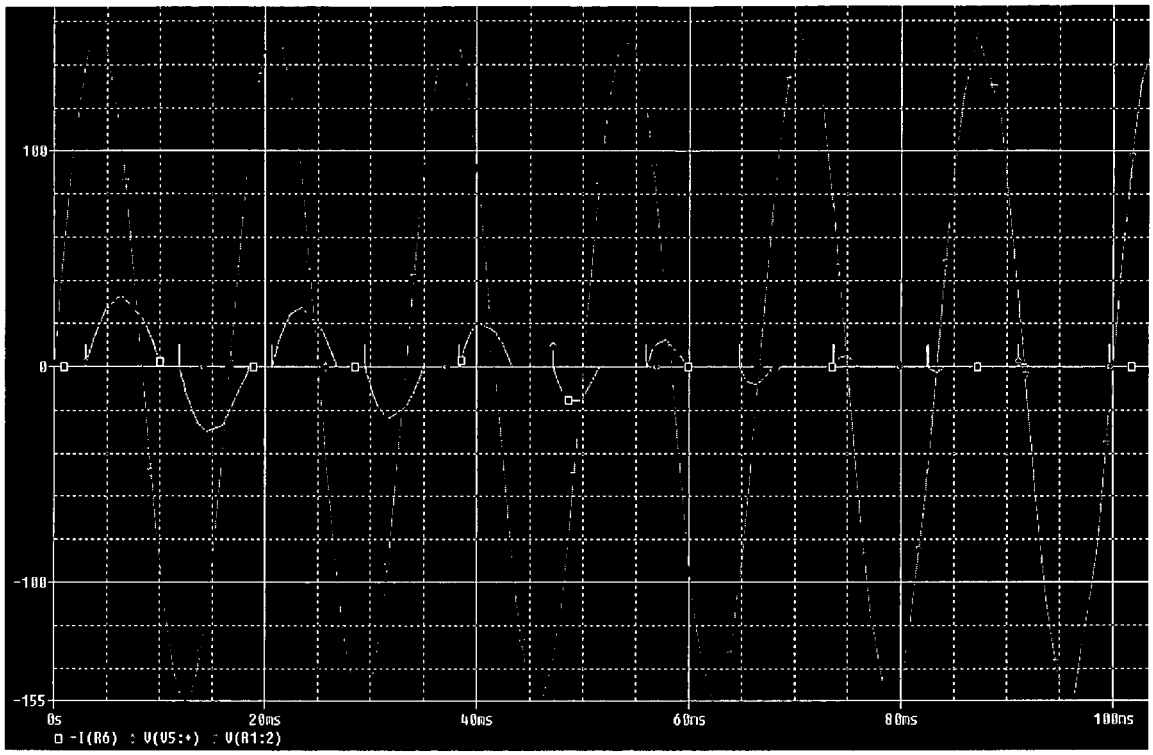
FIG. 5 illustrates a graph of an alternating current (AC) input voltage waveform and a current waveform in accordance with one embodiment.

FIG. 5 illustrates a graph of an AC input voltage waveform and a current waveform in accordance with one embodiment. FIG. 5 illustrates a graph of an AC input voltage waveform and a coil current waveform using the values shown in FIG. 4. As shown in FIG. 5, the successive delay times in the start of the coil current through coil 210 result in corresponding decreases in peak coil current. The resulting coil current waveform may generate a decaying magnetic field to deactivate the EAS marker.

Figure 6:
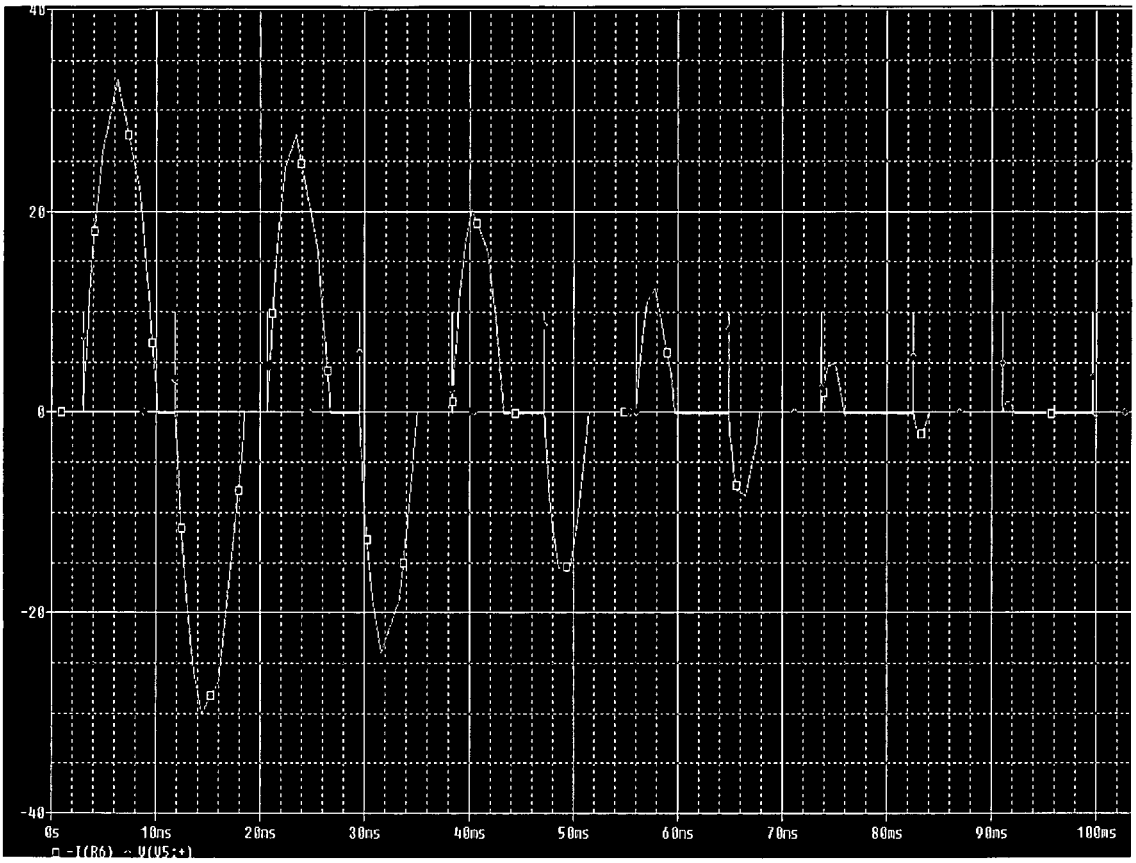
FIG. 6 illustrates a graph of a current waveform in accordance with one embodiment.

FIG. 6 illustrates a graph of a current waveform in accordance with one embodiment. FIG. 6 illustrates a more detailed graph of the coil current waveform using the values shown in FIG. 4. Successive firings of switch 208 at increasing delays with respect to the zero-crossing for the AC input voltage waveform produces an exponentially decaying current waveform. The exponentially decaying waveform may be sufficient to produce an alternating magnetic field to deactivate the EAS marker for EAS security tags brought in close proximity to coil 210. The magnetic field is generated by the product of the number of coil turns times the coil current. It is worthy to note that by reducing the coil current by a factor of approximately 10–20, and increasing the number of coil turns by the same factor, the magneto motive force (mmf) remains approximately constant.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments of the invention.

The invention claimed is:

1. A method comprising:

generating a first signal to represent zero crossings for an alternating current (AC) input voltage waveform;

determining a zero crossing period using said first signal;

retrieving a plurality of delay times using said zero crossing period;

generating a second signal using said first signal and said delay times; and applying said AC input voltage to a coil in accordance with said second signal to create a magnetic field to deactivate an EAS marker.

2. The method of claim 1, wherein said applying creates a current waveform corresponding to an amplitude profile over a time interval.

3. The method of claim 2, wherein said current waveform decreases in amplitude over said time interval in accordance with said amplitude profile.

4. The method of claim 3, wherein said decrease in amplitude is exponential.

5. The method of claim 1, wherein said generating comprises:

retrieving a zero crossing time from said first signal;

retrieving a delay time from said plurality of delay times;

measuring a time interval between said zero crossing time and said delay time; and generating said second signal to indicate an end of said time interval.

6. The method of claim 1, further comprising:

detecting said EAS marker; and sending a detection signal to a zero crossing detector.

7. An apparatus, comprising:

a zero crossing circuit to detect zero crossings of an alternating current (AC) input voltage waveform, and generate a first signal to represent said zero crossings;

a processor to connect to said zero crossing circuit, said processor to receive said first signal and retrieve a plurality of delay times based on said first signal, and to generate a second signal using said first signal and said delay times; and a coil circuit to connect to said processor, said coil circuit to receive said second signal and create a magnetic field to deactivate an electronic article surveillance (EAS) marker.

8. The apparatus of claim 7, wherein said coil circuit comprises:

an AC voltage source to generate said AC input voltage;

a coil to couple to said AC voltage source; and a switch to couple to said coil and receive said second signal, said switch to apply said AC input voltage to said coil in response to said second signal.

9. The apparatus of claim 8, wherein said first signal comprises a pulse train with each pulse to represent a zero crossing, each delay time represents a different time interval between an edge of a pulse from said pulse train and a start time to apply said AC input voltage to said coil, and said second signal represents said start times.

10. The apparatus of claim 9, wherein said delay times increase over time.

11. The apparatus of claim 9, wherein a peak current per cycle for said coil decreases as delay times increase.

12. The apparatus of claim 11, wherein said switch is a triode alternating current (TRIAC) switch.

13. The apparatus of claim 12, wherein said TRIAC switch is closed to apply said AC input voltage to said coil, with said TRIAC switch to automatically commutate open over a time interval.

14. The apparatus of claim 8, wherein said coil comprises an inductor and a parasitic resistor.

15. The apparatus of claim 14, wherein said magnetic field decays over time.

16. The apparatus of claim 15, wherein said decaying magnetic field is proportional to a number of turns in said coil times a peak coil current.

17. The apparatus of claim 7, wherein said processor determines a zero crossing period based on said first signal and uses said zero crossing period to retrieve said delay times, with each delay time to represent a time between said zero crossings.

18. The apparatus of claim 7, further comprising a marker detector to detect said EAS marker.

19. An article comprising:

a processor;

a computer-readable storage medium accessible by said processor;

said computer-readable storage medium including stored instructions that, when read and executed by said processor, result in determining a zero crossing period using a first signal to represent zero crossings from an alternating current (AC) input voltage waveform, retrieving a plurality of delay times using said zero crossing period, generating a second signal using said first signal and said delay times, and sending said second signal to a coil circuit to create a magnetic field to deactivate an electronic article surveillance (EAS) marker.

20. The article of claim 19, wherein the stored instructions, when executed by said processor, further result in said generating by retrieving a zero crossing time from said first signal, retrieving a delay time from said plurality of delay times, measuring a time interval between said zero crossing time and said delay time, and generating said second signal to indicate an end of said time interval.

21. An electronic article surveillance deactivator, comprising:

a zero crossing circuit to detect zero crossings of an alternating current (AC) input voltage waveform, and generate a first signal to represent said zero crossings;

a processor to retrieve a plurality of delay times, and generate a second signal using said first signal and said delay times; and a coil circuit to use said second signal to deactivate an electronic article surveillance (EAS) marker using phase control of said AC input voltage.

22. The deactivator of claim 21, wherein said coil circuit comprises:

an AC voltage source to generate said AC input voltage;

a coil to couple to said AC voltage source; and a switch to couple to said coil and receive said second signal, said switch to apply said AC input voltage to said coil in response to said second signal.

* * * * *